US009979140B2

(12) United States Patent
I

(10) Patent No.: US 9,979,140 B2
(45) **Date of Patent: *May 22, 2018**

(54) CONDUCTIVE SPRING PLATE FIXING ELEMENT, PLUG AND SOCKET

(71) Applicant: Green Idea Tech Inc., Mahe (SC)

(72) Inventor: Hsiang-Yun I, Tainan (TW)

(73) Assignee: GREEN IDEA TECH INC., Mahe (SC)

( * ) Notice: Subject to any disclaimer, the term of this patent is extended or adjusted under 35 U.S.C. 154(b) by 21 days.

This patent is subject to a terminal disclaimer.

(21) Appl. No.: 15/275,911

(22) Filed: Sep. 26, 2016

(65) Prior Publication Data

US 2018/0090888 A1 Mar. 29, 2018

(51) Int. Cl.

| | |
|---|---|
| ***H01R 13/08*** | (2006.01) |
| ***H01R 13/696*** | (2011.01) |
| ***H01R 24/20*** | (2011.01) |
| *H01R 103/00* | (2006.01) |

(52) U.S. Cl.

CPC ..... *H01R 13/696* (2013.01); *H01R 24/20* (2013.01); *H01R 2103/00* (2013.01)

(58) Field of Classification Search

CPC ..... H01R 13/68; H01R 13/696; H01R 24/20; H01R 13/688; H01R 13/6666

USPC ..... 439/620.3, 620.26, 620.08, 510

See application file for complete search history.

(56) References Cited

U.S. PATENT DOCUMENTS

| | | | | |
|---|---|---|---|---|
| 5,906,515 | A * | 5/1999 | Lin | H01R 13/68 337/197 |
| 6,547,600 | B2 * | 4/2003 | Yen | H01R 13/68 439/460 |
| 7,021,968 | B1 * | 4/2006 | Lu | H01R 13/502 439/620.07 |
| 7,803,019 | B2 * | 9/2010 | Yen | H01R 13/6641 439/620.01 |
| 9,257,798 | B2 | 2/2016 | Wang | |
| 9,627,821 | B1 * | 4/2017 | I | H01R 13/68 |
| 2007/0008061 | A1 * | 1/2007 | Chen | H01R 13/68 337/187 |
| 2017/0110836 | A1 * | 4/2017 | Wang | H01R 13/696 |

FOREIGN PATENT DOCUMENTS

| | | |
|---|---|---|
| TW | M509999 | 10/2015 |

* cited by examiner

*Primary Examiner* — Abdullah Riyami
*Assistant Examiner* — Nader Alhawamdeh
(74) *Attorney, Agent, or Firm* — Muncy, Geissler, Olds & Lowe, P.C.

(57) ABSTRACT

A conductive spring plate fixing element is used to limit a live wire spring plate and a live wire conductive plate from contacting with each other, as well as a neutral wire spring plate and a neutral wire conductive plate from contacting with each other. The width of the limited part of the live wire spring plate is T1, the width of the limited part of the neutral wire spring plate is T2, and the live wire spring plate is separated from the neutral wire spring plate by an insulation distance L. The conductive spring plate fixing element includes a first limiting end and a second limiting end; whereas, the distance between the first limiting end and the second limiting end, M, is equal to T1+T2+L.

10 Claims, 18 Drawing Sheets

CONDUCTIVE SPRING PLATE FIXING ELEMENT, PLUG AND SOCKET

BACKGROUND OF THE INVENTION a) Field of the Invention

The present invention relates to a conductive spring plate fixing element, plug and socket, and more particularly to an invention assuring that when a live wire spring plate and a live wire conductive plate are overheated or a neutral wire spring plate and a neutral wire conductive plate are overheated, the live wire spring plate, the live wire conductive plate, the neutral wire spring plate and the neutral wire conductive plate are separated apart at a same time.

b) Description of the Prior Art

To prevent a circuit from issues of current overload, short circuit and overheating, a fuse or an overload protector is usually provided at the circuit. When the temperature of the circuit gets too high or the current gets too large, the fuse affected by the high temperature becomes blown or a bi-metal shrapnel of the overload protector becomes disengaged, so as to cause the circuit become open circuit and turned off to ensure electricity safety.

The Taiwan Utility Model Patent M509999, "Overheating Destructive Insulative Fixing Plate as well as a Plug and a Socket Using that Insulative Fixing Plate," has disclosed an overheating destructive insulative fixing plate, which includes a connecting element and two limiting elements combined at two ends of the connecting element to form an H-shaped structure. The connecting element is put into the grooves formed on the conductive elements, enabling the two limiting elements to be abutted at an exterior side of the conductive element respectively and limiting the two conductive elements from contacting with each other. The connecting element is destructed when overheating, forming an open circuit between the two conductive elements.

However, each live wire spring plate and each live wire conductive plate will use an overheating destructive fixing plate, and each neutral wire spring plate and each neutral wire conductive plate will use another overheating destructive fixing plate, as shown in FIG. 21 of the abovementioned patent M509999. When a load (electric appliance) is connected between the live wire conductive plate and the neutral wire conductive plate, the electric current will flow through the live wire spring plate, the live wire conductive plate, the load (electric appliance), the neutral wire conductive plate and the neutral wire spring plate orderly to form an open path. If the location of overheating is between the neutral wire spring plate and the neutral wire conductive plate, then the fixing plate between the neutral wire spring plate and the neutral wire conductive plate will be destructed due to overheating. At this time, the fixing plate between the live wire spring plate and the live wire conductive plate may not be destructed. Therefore, the high electric current can still enter into the load prior to forming an open circuit; whereas, if electricity leaks out of the load and an operator touches the load under grounding, then the operator may get an electric shock.

Furthermore, in the embodiment shown in FIG. 1, FIG. 2 and FIG. 3 of the U.S. Pat. No. 9,257,798, a limiting element is used independently between the live wire conductive plate and the live wire contact portion, and another limiting element is also used independently between the neutral wire conductive plate and the neutral wire contact portion.

Accordingly, that U.S. Pat. No. 9,257,798 is also provided with the same issue as the abovementioned Taiwan Utility Model Patent M509999. In other words, under overheating, in the structure disclosed in the U.S. Pat. No. 9,257,798, it is possible that only the limiting element between the neutral wire conductive plate and the neutral wire contact portion is destructed, but the limiting element between the live wire conductive plate and the live wire contact portion remains intact.

SUMMARY OF THE INVENTION

Accordingly, to assure that the live wire spring plate and the live wire conductive plate located before the load can be tripped off actually when the electric circuit is overheated, the present invention discloses a conductive spring plate fixing element.

The conductive spring plate fixing element is used to limit a live wire spring plate and a live wire conductive plate from contacting with each other, and a neutral wire spring plate and a neutral wire conductive plate from contacting with each other. The width of the limited part of the live wire spring plate is T1, the width of the limited part of the neutral wire spring plate is T2, and the live wire spring plate is separated from the neutral wire spring plate by an insulation distance L. The conductive spring plate fixing element includes a first limiting element, a second limiting element and a connecting element. The connecting element is connected with the first limiting element and the second limiting element. The first limiting element is provided with a first limiting end, the second limiting element is provided with a second limiting end, and the distance between the first limiting end and the second limiting end, M, is equal to T1+T2+L, such that the first limiting end of the first limiting element and the second limiting end of the second limiting element can be abutted respectively at the live wire spring plate and the neutral wire spring plate; whereas, the connecting element is used to limit the live wire spring plate and the neutral wire spring plate, such that the live wire spring plate and the live wire conductive plate can contact with each other, as well as the neutral wire spring plate and the neutral wire conductive plate can contact with each other. In addition, the live wire spring plate and the neutral wire spring plate are provided at a same time with an elastic force allowing the live wire spring plate and the neutral wire spring plate to move away from each other. When a location between the live wire spring plate and the live wire conductive plate is overheated or a location between the neutral wire spring plate and the neutral wire conductive plate is overheated, if any one location in the first limiting element, the second limiting element or the connecting element is destructed, then the first limiting element, the second limiting element and the connecting element will all lose the original limiting function thereof, allowing the live wire spring plate, the live wire conductive plate, the neutral wire spring plate and the neutral wire conductive plate to be separated apart at a same time.

Furthermore, the live wire spring plate is formed with a first notch, the neutral wire spring plate is formed with a second notch, and the first notch and the second notch are used to accommodate the connecting element.

Furthermore, the live wire spring plate is formed with a first bending portion, and the neutral wire spring plate is formed with a second bending portion; whereas, the first limiting end of the first limiting element and the second limiting end of the second limiting element are abutted respectively at the first bending portion of the live wire spring plate and the second bending portion of the neutral wire spring plate.

Furthermore, the first limiting element is formed with a first collar to sheath the live wire spring plate, and the second limiting element is formed with a second collar to sheath the neutral wire spring plate.

Furthermore, the first limiting element, the second limiting element and the connecting element are all made of plastic, the first limiting element and the second limiting element are in a shape of plates, a destructive portion is disposed between the connecting element and the first limiting element, as well as between the connecting element and the second limiting element, and the thickness of the destructive portion is smaller than the thickness of the connecting element.

Furthermore, the first limiting element and the second limiting element are made of metal, and the connecting element is made of plastic. A destructive portion is disposed between the connecting element and the first limiting element, as well as between the connecting element and the second limiting element.

Furthermore, the first limiting element and the second limiting element are all in a shape of bumps which are formed respectively at two opposite ends of the connecting element.

Furthermore, the live wire conductive plate includes plural live wire slots and contacts with one single live wire spring plate. The neutral wire conductive plate includes plural neutral wire slots and contacts with one single neutral wire spring plate. Under a normal condition, the live wire conductive plate, the live wire spring plate, the neutral wire conductive plate and the neutral wire spring plate are commonly limited by the first limiting element, the second limiting element and the connecting element.

The present invention also discloses a socket which uses the abovementioned conductive spring plate fixing element. The socket includes an insulative unit, a live wire conductive plate, a neutral wire conductive plate, a live wire spring plate and a neutral wire spring plate. The insulative unit is provided at least with a live wire receptacle and an opposite neutral wire receptacle. The live wire conductive plate is installed in the insulative unit and corresponds to the live wire receptacle. The neutral wire conductive plate is installed in the insulative unit and corresponds to the neutral wire receptacle. The live wire spring plate is installed in the insulative unit and corresponds to the live wire conductive plate. The neutral wire spring plate is installed in the insulative unit and corresponds to the neutral wire conductive plate. By abutting the first limiting element and the second limiting element of the conductive spring plate fixing element at the live wire spring plate and the neutral wire spring plate respectively, and by using the connecting element to limit the live wire spring plate and the neutral wire spring plate, the live wire spring plate and the live wire conductive plate will contact with each other, as well as the neutral wire spring plate and the neutral wire conductive plate will contact with each other. In addition, when a location between the live wire spring plate and the live wire conductive plate is overheated or a location between the neutral wire spring plate and the neutral wire conductive plate is overheated, if any one location in the first limiting element, the second limiting element or the connecting element is destructed, then the first limiting element, the second limiting element and the connecting element will all lose the original limiting function thereof, allowing the live wire spring plate, the live wire conductive plate, the neutral wire spring plate and the neutral wire conductive plate to be separated apart at a same time.

The present invention also discloses a plug which uses the abovementioned conductive spring plate fixing element. The plug includes an insulative unit, a live wire conductive plate, a neutral wire conductive plate, a live wire spring plate and a neutral wire spring plate. The live wire conductive plate is disposed in the insulative unit and is extended out of the insulative unit. The neutral wire conductive plate is disposed in the insulative unit and is extended out of the insulative unit. The live wire spring plate is disposed in the insulative unit and corresponds to the live wire conductive plate. The neutral wire spring plate is disposed in the insulative unit and corresponds to the neutral wire conductive plate. By abutting the first limiting element and the second limiting element of the conductive spring plate fixing element at the live wire spring plate and the neutral wire spring plate respectively, and by using the connecting element to limit the live wire spring plate and the neutral wire spring plate, the live wire spring plate and the live wire conductive plate will contact with each other, as well as the neutral wire spring plate and the neutral wire conductive plate will contact with each other. In addition, when a location between the live wire spring plate and the live wire conductive plate is overheated or a location between the neutral wire spring plate and the neutral wire conductive plate is overheated, if any one location in the first limiting element, the second limiting element or the connecting element is destructed, then the first limiting element, the second limiting element and the connecting element will all lose the original limiting function thereof, allowing the live wire spring plate, the live wire conductive plate, the neutral wire spring plate and the neutral wire conductive plate to be separated apart at a same time.

The following benefits can be resulted from the abovementioned technical features:

1. The distance between the first limiting end of the first limiting element and the second limiting end of the second limiting element M is the summation of the width of the limited part of the live wire spring plate T1 and the width of the limited part of the neutral wire spring plate T2, which assures that the live wire spring plate and the live wire conductive plate can be limited from contacting with each other, as well as the neutral wire spring plate and the neutral wire conductive plate can be limited from contacting with each other.
2. As the electric current flows in from the path of the live wire and flows out from the path of the neutral wire, the present invention can assure that when the working temperature is too high, the current will be terminated actually at the end where the electric current flows in. In other words, as long as that the abovementioned conductive spring plate fixing element is destructed, the live wire spring plate will be definitely separated from the live wire conductive plate, and the neutral wire spring plate will be definitely separated from the neutral wire conductive plate.
3. By forming the first bending portion on the live wire spring plate and the second bending portion on the neutral wire spring plate respectively, the relative position between the first bending portion and the second bending portion will be fixed. Therefore, only one size is needed for the conductive spring plate fixing element to apply to various plugs or sockets.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

According to the abovementioned technical features, the primary benefits of the conductive spring plate fixing element, plug and socket can be clearly disclosed in the following embodiments.

Figure 1:
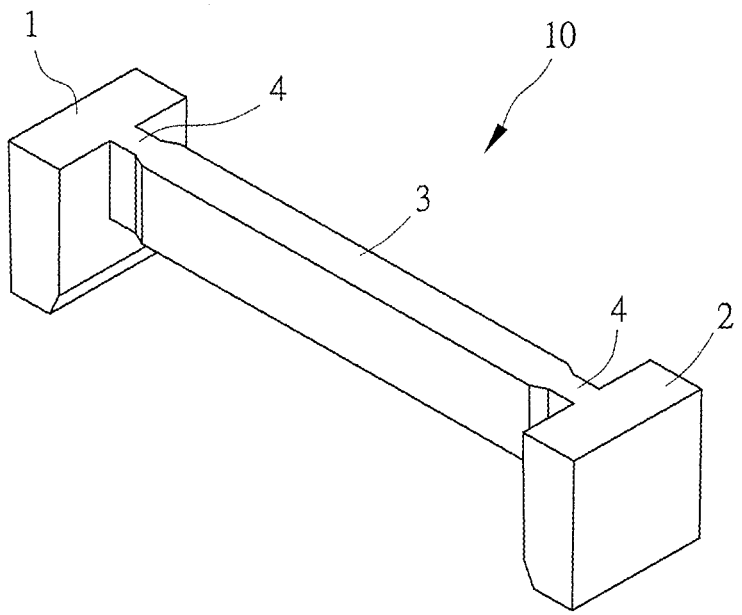
FIG. 1 shows a three-dimensional view of appearance of a conductive spring plate fixing element, according to a first embodiment of the present invention.
Figure 2:
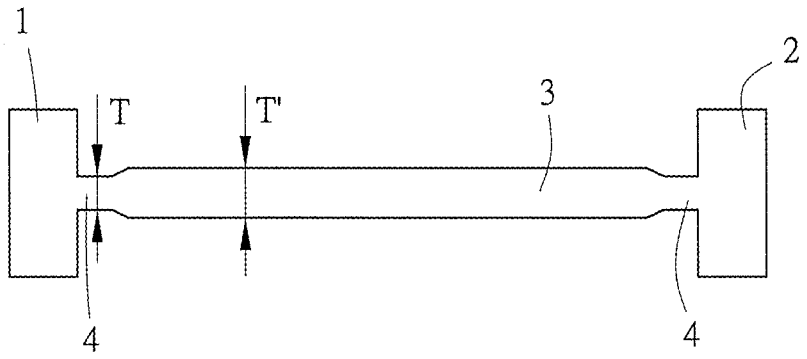
FIG. 2 is a top view of FIG. 1.

Referring to FIG. 1 and FIG. 2 for the first embodiment of the present invention, the conductive spring plate fixing element 10, according to the present embodiment, comprises a first limiting element 1, a second limiting element 2 and a connecting element 3. The connecting element 3 is connected with the first limiting element 1 and the second limiting element 2, forming an H-shaped structure to the conductive spring plate fixing element 10. The first limiting element 1, the second limiting element 2 and the connecting element 3 are selectively made of a thermal destructive material, such as plastic. The thermal destructive material is allowed to be destructed at a temperature of 80° C.~299° C., and the first limiting element 1 and the second limiting element 2 are in a plate shape. A destructive portion 4 is disposed between the connecting element 3 and the first limiting element 1 as well as between the connecting element 3 and the second limiting element 2. In addition, the width T of the destructive portion 4 is smaller than the width T' of the connecting element 3.

Figure 3:
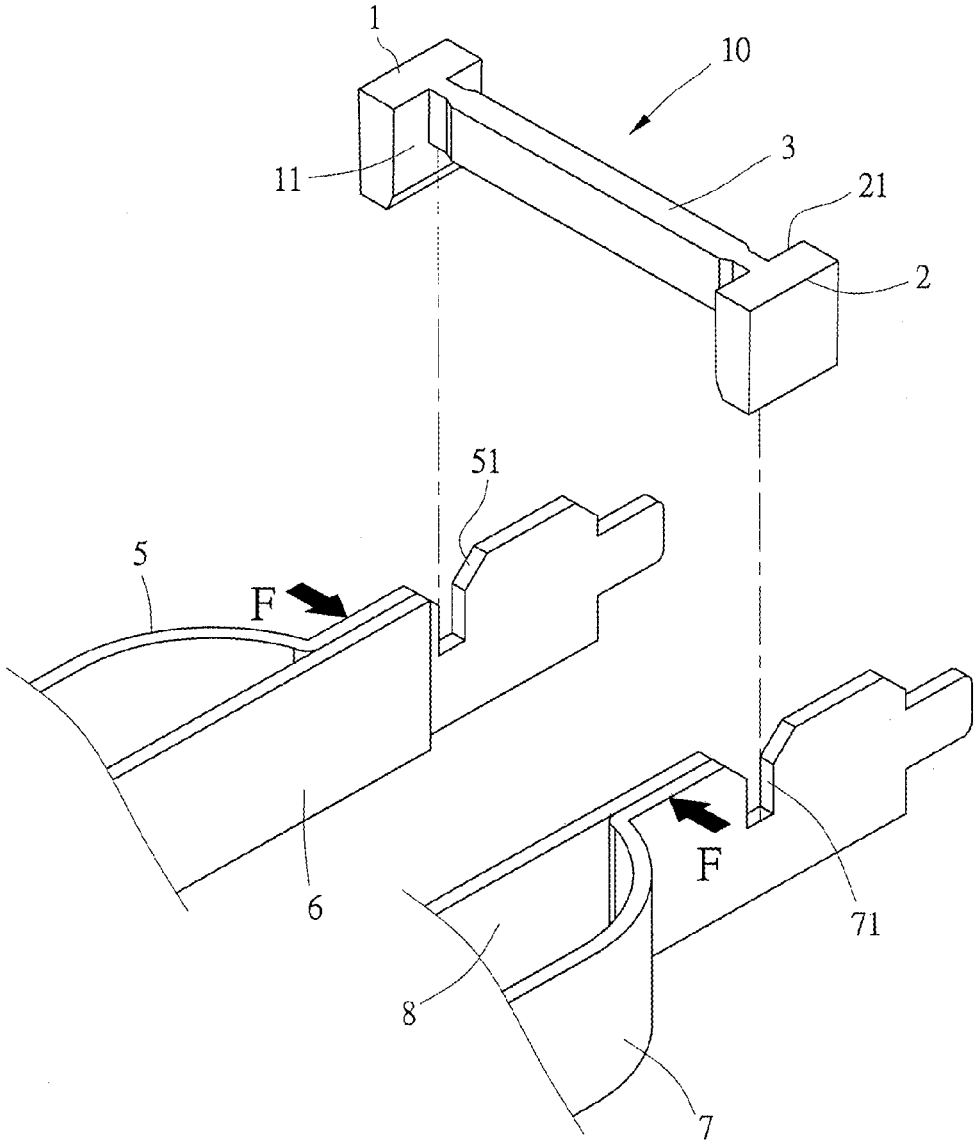
FIG. 3 shows an exploded view of combining the conductive spring plate fixing element with a live wire spring plate and a neutral wire spring plate, according to the first embodiment of the present invention.
Figure 4:
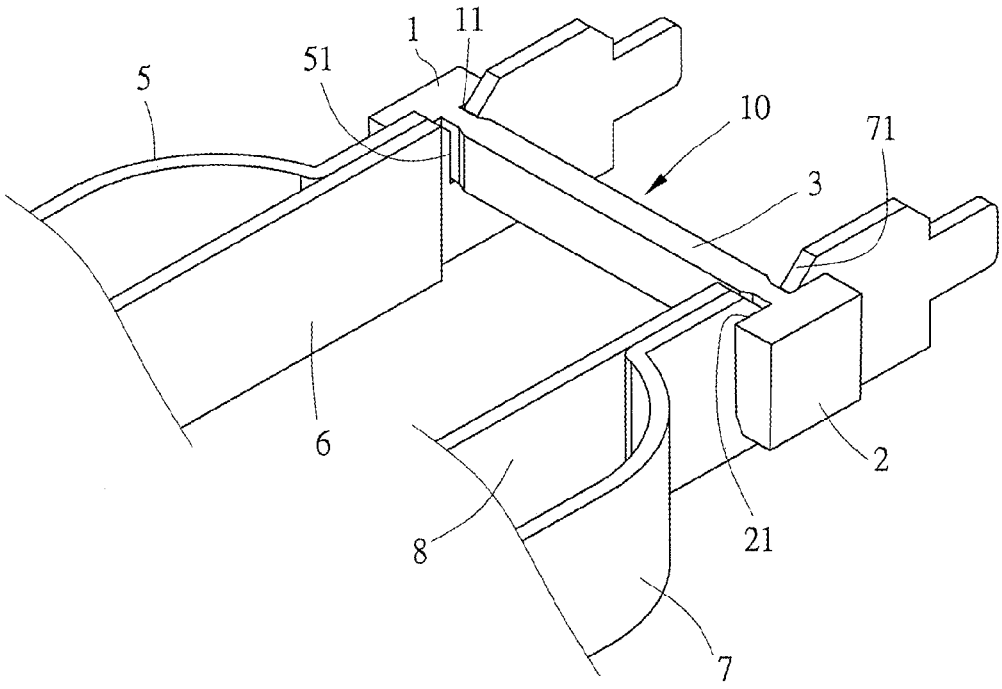
FIG. 4 shows a schematic view of combining the conductive spring plate fixing element with the live wire spring plate and the neutral wire spring plate, according to the first embodiment of the present invention.
Figure 5:
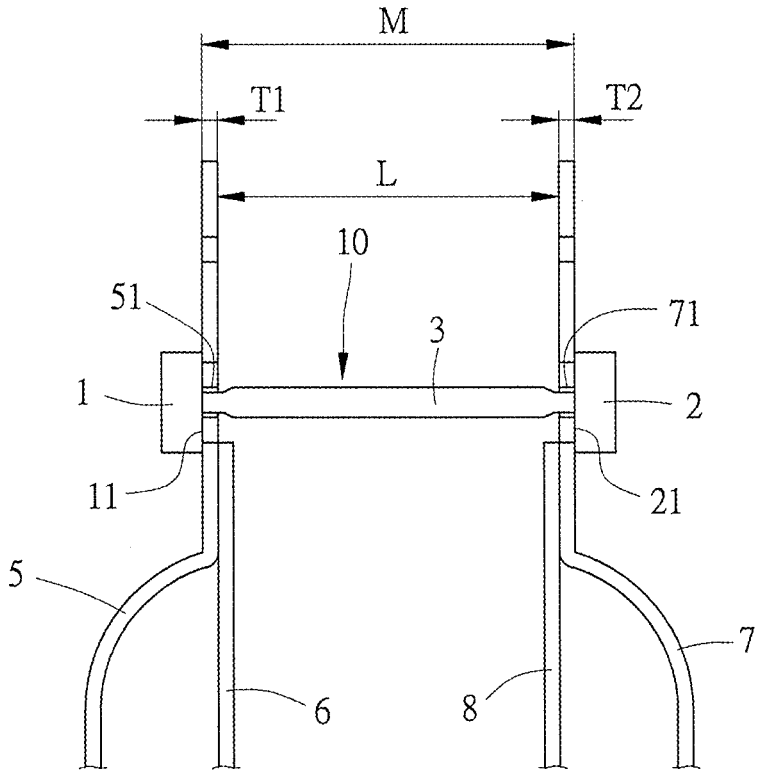
FIG. 5 is a top view of FIG. 4.

Referring to FIGS. 3 to 5, the conductive spring plate fixing element 10 is used to limit a live wire spring plate 5 and a live wire conductive plate 6 from contacting with each other, as well as a neutral wire spring plate 7 and a neutral wire conductive plate 8 from contacting with each other. The width of the limited part of the live wire spring plate 5 is T1 and the width of the limited part of the neutral wire spring plate 7 is T2. Upon assembling, the live wire spring plate 5 is formed with a first notch 51, and the neutral wire spring plate 7 is formed with a second notch 71. An external force F is applied first to abut the live wire spring plate 5 at the live wire conductive plate 6, and to abut the neutral wire spring plate 7 at the neutral wire conductive plate 8. Under this condition, the live wire spring plate 5 and the neutral wire spring plate 7 will be provided at a same time an elastic force allowing the live wire spring plate 5 and the neutral wire spring plate 7 to move away from each other, and at this time, the live wire spring plate 5 is separated from the neutral wire spring plate 7 by an insulation distance L. The first limiting element 1 is provided with a first limiting end 11, the second limiting element 2 is provided with a second limiting end 21, the first limiting end 11 and the second limiting end 21 are disposed at two opposite inner surfaces of the first limiting element 1 and the second limiting element 2. The distance between the first limiting end 11 and the second limiting end 21, M, is equal to T1+T2+L. Therefore, the first limiting end 11 of the first limiting element 1 and the second limiting end 21 of the second limiting element 2 can be abutted respectively at the live wire spring plate 5 and the neutral wire spring plate 7, and the connecting element 3 can be accommodated in the first notch 51 and the second notch 71, so as to limit the live wire spring plate 5 and the neutral wire spring plate 7, allowing the live wire spring plate 5 and the live wire conductive plate 6 to contact with each other, as well as the neutral wire spring plate 7 and the neutral wire conductive plate 8 to contact with each other.

Figure 6:
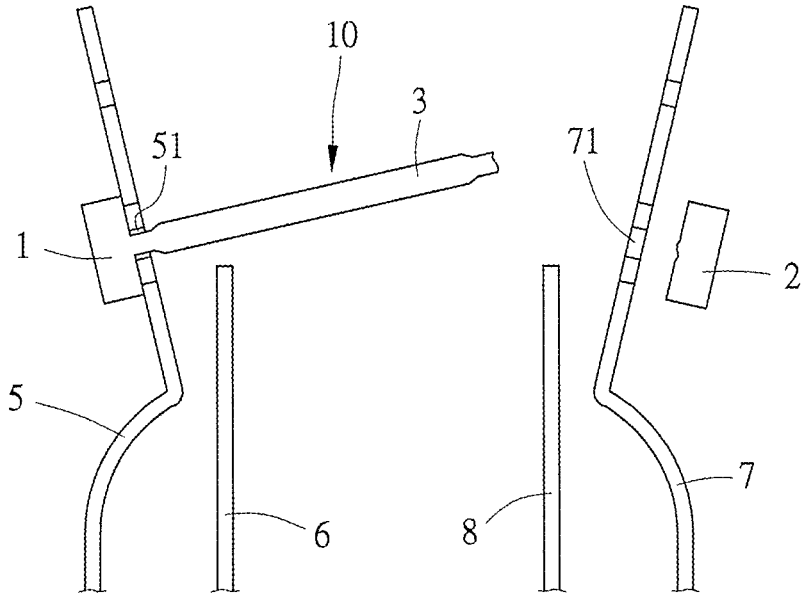
FIG. 6 shows a schematic view illustrating that the conductive spring plate fixing element is destructed due to overheating, so that the live wire spring plate and the neutral wire spring plate can be tripped off, according to the first embodiment of the present invention.

Referring to FIG. 6, when a location between the live wire spring plate 5 and the live wire conductive plate 6 is overheated or a location between the neutral wire spring plate 7 and the neutral wire conductive plate 8 is overheated, if any one location in the first limiting element 1, the second limiting element 2 or the connecting element 3 is destructed (usually the destruction portion 4 is destructed), then the first limiting element 1, the second limiting element 2 and the connecting element 3 will all lose the original limiting function thereof, allowing the live wire spring plate 5 and the neutral wire spring plate 7 to move away from each other by the elastic force which enables the live wire spring plate 5 to move away from the neutral wire spring plate 7. At this time, the live wire spring plate 5 will be separated from the live wire conductive plate 6, and the neutral wire spring plate 7 will be separated from the neutral wire conductive plate 8 at a same time.

Figure 7:
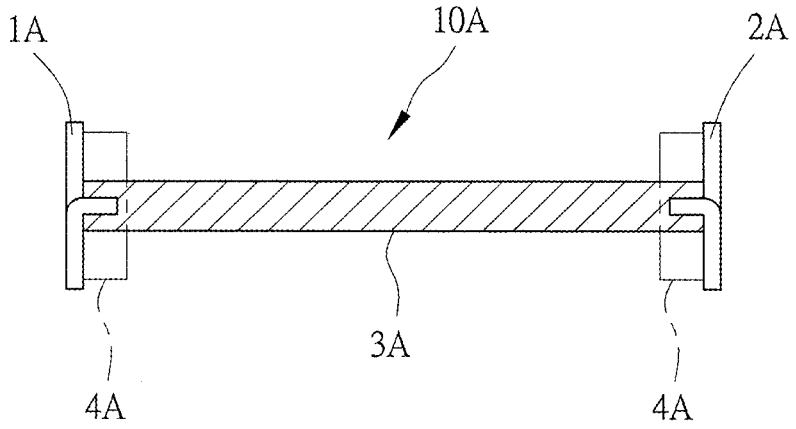
FIG. 7 shows a schematic view illustrating that the conductive spring plate fixing element is made of metal combined with plastic, according to a second embodiment of the present invention.

Referring to FIG. 7 for the second embodiment of the present invention, the conductive spring plate fixing element 10A, according to the present embodiment, comprises a first limiting element 1A, a second limiting element 2A and a connecting element 3A. The connecting element 3A is connected with the first limiting element 1A and the second limiting element 2A, forming an H-shaped structure to the conductive spring plate fixing element 10A. The first limiting element 1A and the second limiting element 2A are made of metal, and the connecting element 3A is made of plastic. A destructive portion 4A is disposed between the connecting element 3A and the first limiting element 1A as well as between the connecting element 3A and the second limiting element 2A respectively. In the present embodiment, heat can be transferred more uniformly and rapidly by the first limiting element 1A and the second limiting element 2A as they are made of metal, assuring that the abovementioned destructive portion 4A can be destructed when an open path is overheated.

Figure 8:
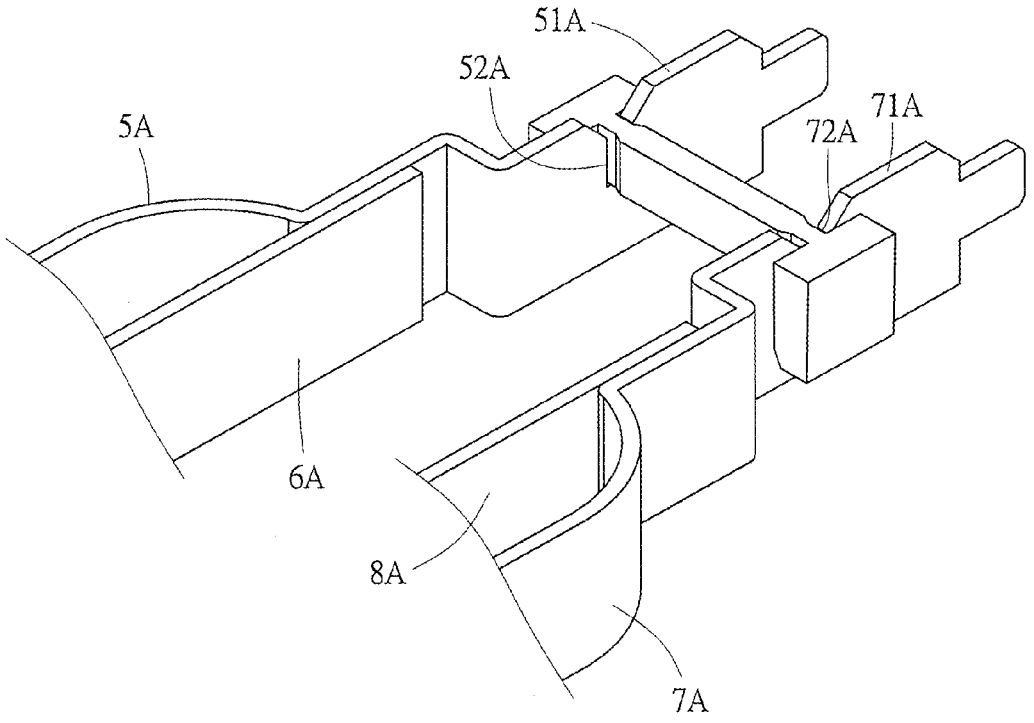
FIG. 8 shows a first schematic view of assembly, according to a third embodiment of the present invention.
Figure 9:
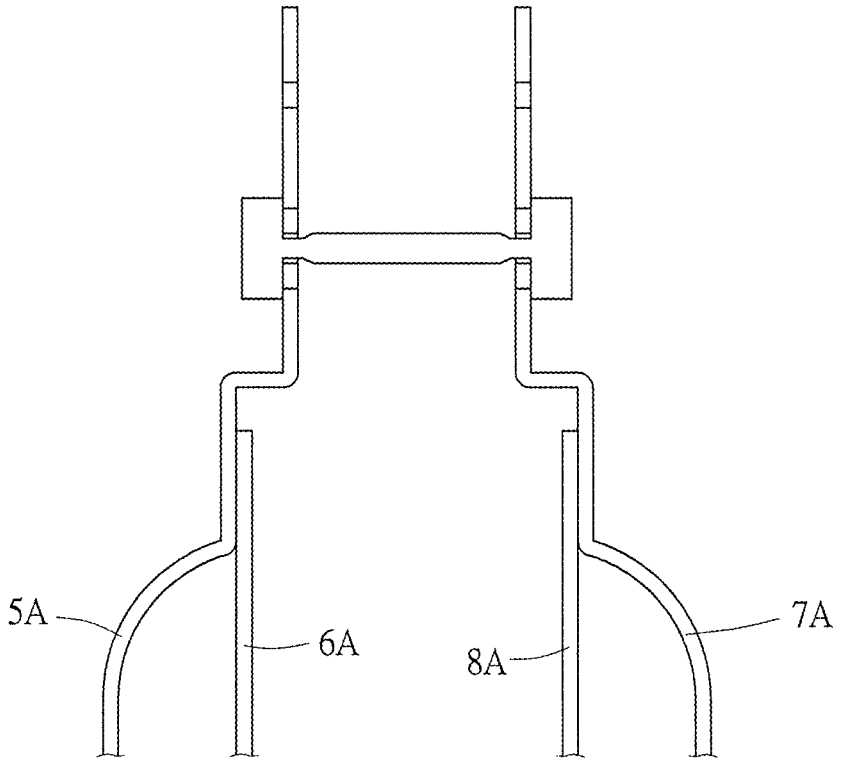
FIG. 9 shows a second schematic view of assembly, according to the third embodiment of the present invention.
Figure 10:
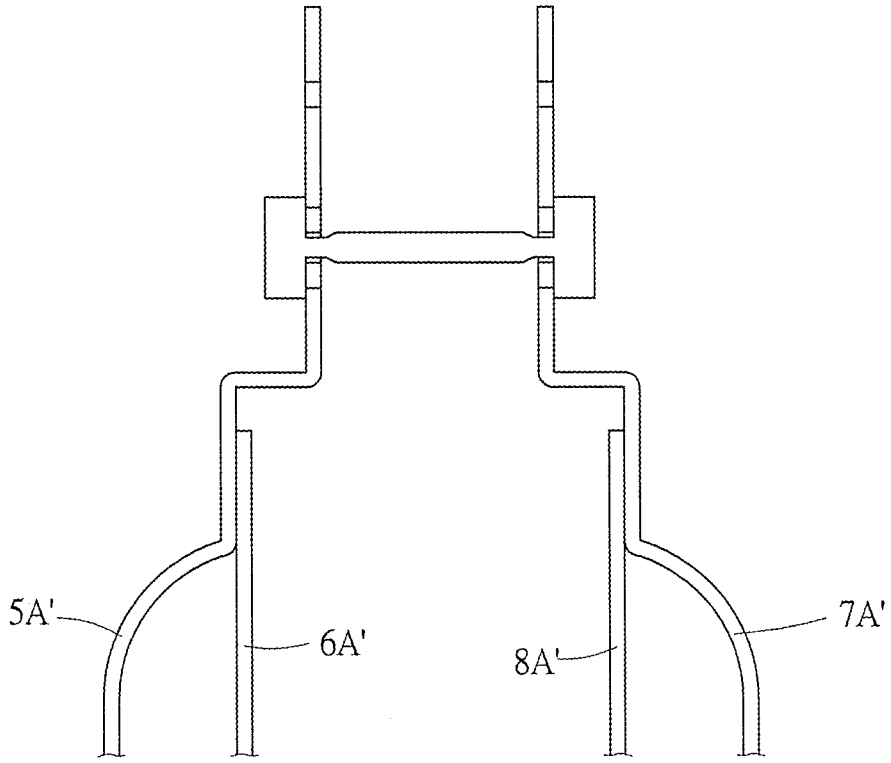
FIG. 10 shows a third schematic view of assembly, according to the third embodiment of the present invention.

Referring to FIG. 8 for the third embodiment of the present invention, the present embodiment comprises a live wire spring plate 5A, a live wire conductive plate 6A, a neutral wire spring plate 7A and a neutral wire conductive plate 8A. The live wire spring plate 5A is formed with a first bending portion 51A on which is provided with a first groove 52A, and the neutral wire spring plate 7A is formed with a second bending portion 71A on which is provided with a second groove 72A. Accordingly, referring to FIG. 9 and FIG. 10, only one size is needed for the conductive spring plate fixing element 10, according to the present embodiment, to apply to various live wire spring plates 5A, 5A', live wire conductive plates 6A, 6A', neutral wire spring plates 7A, 7A' and neutral wire conductive plates 8A, 8A'.

Figure 11:
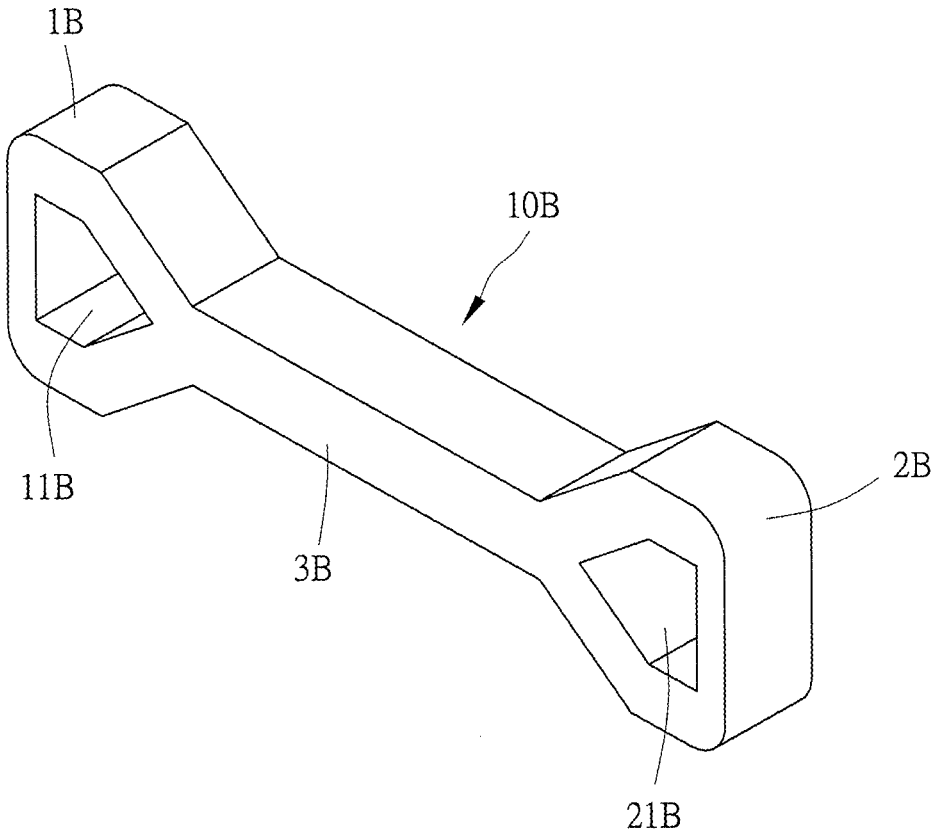
FIG. 11 shows a three-dimensional view of appearance of the conductive spring plate fixing element, according to a fourth embodiment of the present invention.

Referring to FIG. 11 for the fourth embodiment of the present invention, the conductive spring plate fixing element 10B, according to the present embodiment, comprises a first limiting element 1B, a second limiting element 2B and a connecting element 3B. The connecting element 3B is connected with the first limiting element 1B and the second limiting element 2B, the first limiting element 1B is formed with a first collar 11B, and the second limiting element 2B is formed with a second collar 21B.

Figure 12:
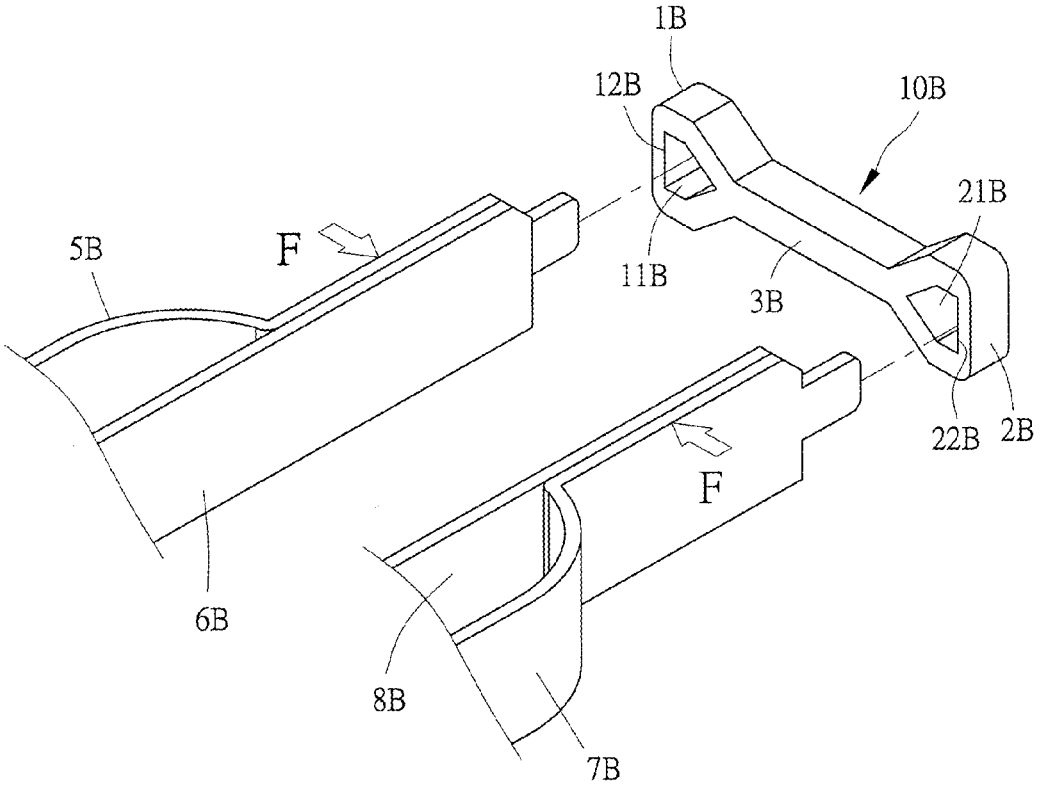
FIG. 12 shows an exploded view of combining the conductive spring plate fixing element with the live wire spring plate and the neutral wire spring plate, according to the fourth embodiment of the present invention.
Figure 13:
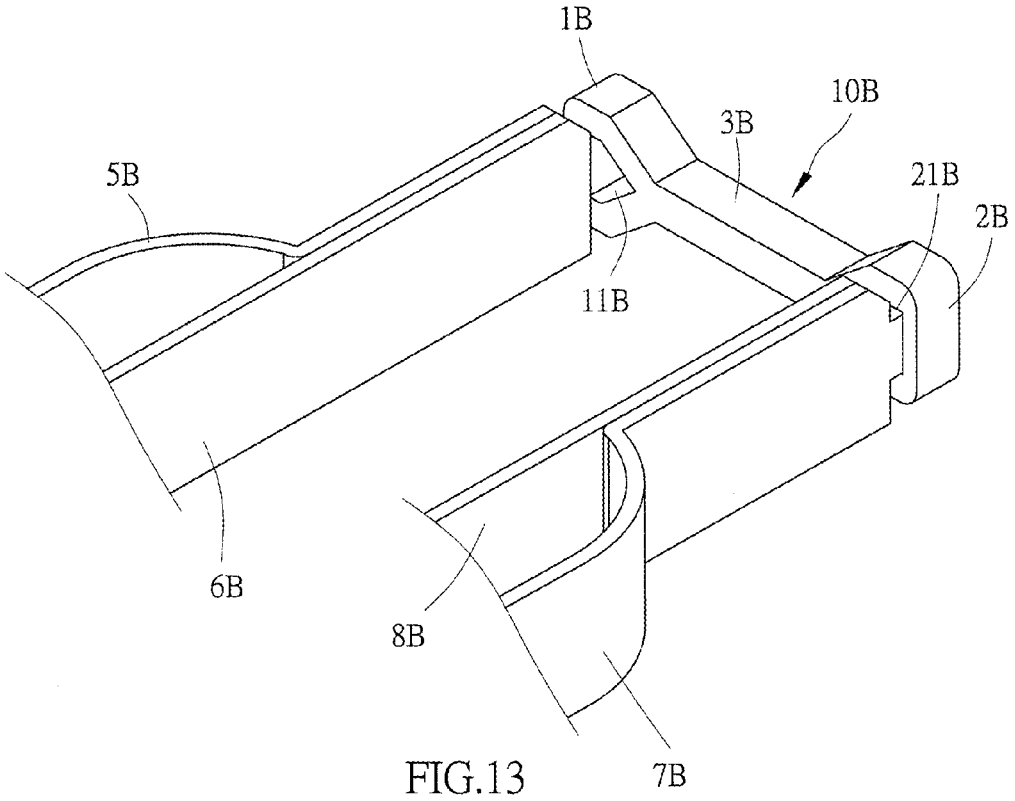
FIG. 13 shows a schematic view of combining the conductive spring plate fixing element with the live wire spring plate and the neutral wire spring plate, according to the fourth embodiment of the present invention.
Figure 14:
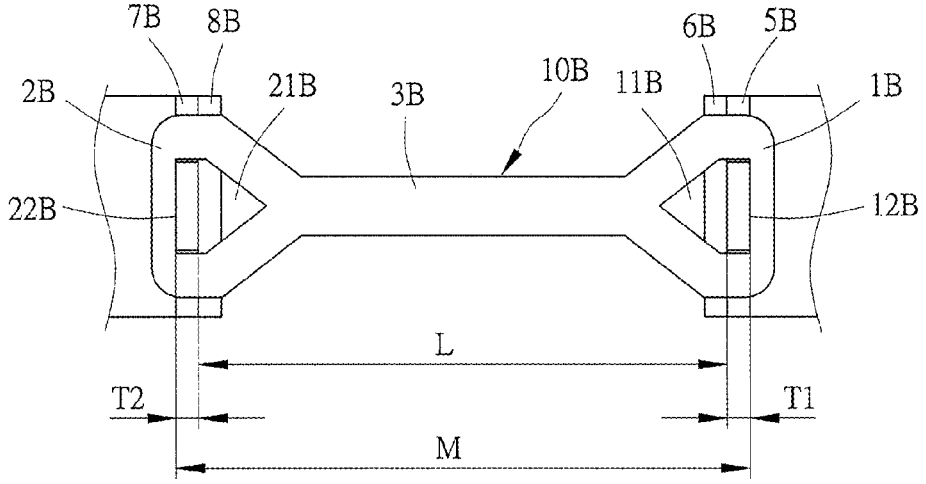
FIG. 14 is a front view of FIG. 13.

Referring to FIGS. 12 to 14, there are a live wire spring plate 5B, a live wire conductive plate 6B, a neutral wire spring plate 7B and a neutral wire conductive plate 8B. The width of the limited part of the live wire spring plate 5B is T1 and the width of the limited part of the neutral wire spring plate 7B is T2. An external force F is applied first to abut the live wire spring plate 5B at the live wire conductive plate 6B, and to abut the neutral wire spring plate 7B at the neutral wire conductive plate 8B. At this time, the live wire spring plate 5B will be separated from the neutral wire spring plate 7B by an insulation distance L, and in the first collar 11B and the second collar 21B, the corresponding surfaces at the farthest distance are the first limiting end 12B and the second limiting end 22B respectively. The distance between the first limiting end 12B and the second limiting end 22B, M, is equal to T1+T2+L. Therefore, the first collar 11B of the first limiting element 1B can be sheathed on the live wire spring plate 5B, and the second collar 21B of the second limiting element 2B can be sheathed on the neutral wire spring plate 7B, so as to limit the live wire spring plate 5B and the neutral wire spring plate 7B, allowing the live wire spring plate 5B and the live wire conductive plate 6B to contact with each other, as well as the neutral wire spring plate 7B and the neutral wire conductive plate 8B to contact with each other.

Figure 15:
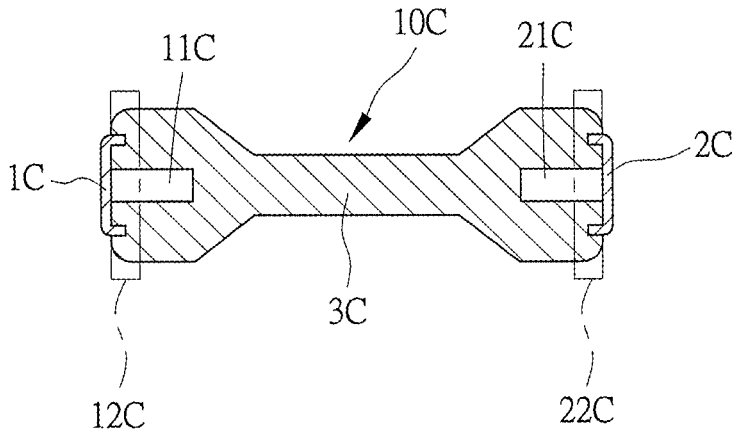
FIG. 15 shows a schematic view illustrating that the conductive spring plate fixing element is made of metal combined with plastic, according to a fifth embodiment of the present invention.

Referring to FIG. 15 for the fifth embodiment of the present invention, the conductive spring plate fixing plate 10C, according to the present embodiment, comprises a first limiting element 1C, a second limiting element 2C and a connecting element 3C. The connecting element 3C is connected with the first limiting element 1C and the second limiting element 2C. A first collar 11C is formed between the first limiting element 1C and the connecting element 3C, and a second collar 21C is formed between the second limiting element 2C and the connecting element 3C. The first limiting element 1C and the second limiting element 2C are made of metal, and the connecting element 3C is made of plastic. A first destruction portion 12C is disposed between the connecting element 3C and the first limiting element 1C, and a second destruction portion 22C is disposed between the connecting element 3C and the second limiting element 2C. In the present embodiment, heat can be also transferred more uniformly and rapidly by the first limiting element 1C and the second limiting element 2C as they are made of metal, which assures that when an open path is overheated, the abovementioned first destructive portion 12C and second destructive portion 22C can be destructed.

Figure 16:
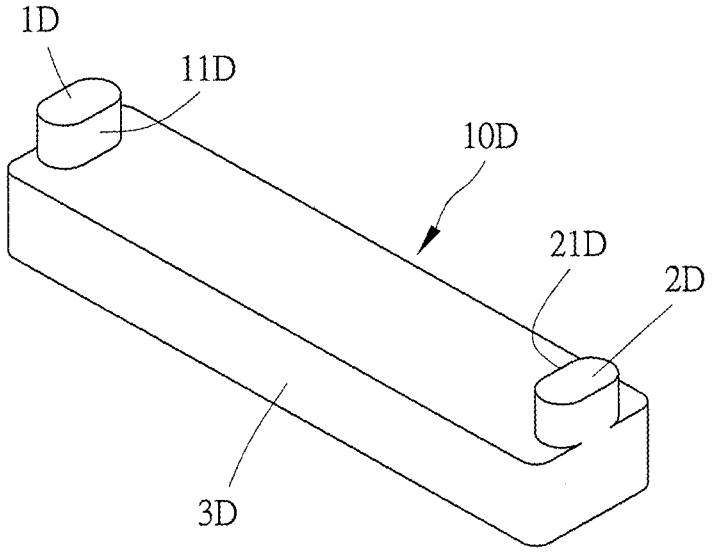
FIG. 16 shows a three-dimensional view of appearance of the conductive spring plate fixing element, according to a sixth embodiment of the present invention.

Referring to FIG. 16 for the sixth embodiment of the present invention, the conductive spring plate fixing element 10D, according to the present embodiment, comprises a first limiting element 1D, a second limiting element 2D and a connecting element 3D. The connecting element 3D is connected with the first limiting element 1D and the second limiting element 2D. The first limiting element 1D and the second limiting element 2D are all in a shape of bumps which are formed respectively at two opposite ends of the connecting element 3D. In addition, the first limiting element 1D is provided with a first limiting end 11D, and the second limiting element 2D is provided with a second limiting end 21D.

Figure 17:
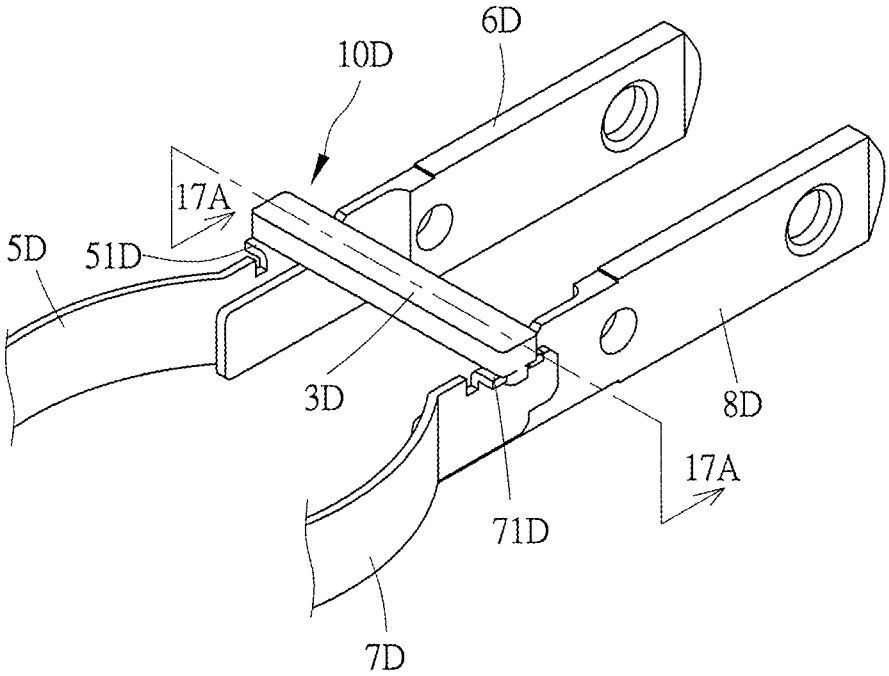
FIG. 17 shows a schematic view illustrating that the conductive spring plate fixing element abuts inward at the live wire spring plate and the neutral wire spring plate, according to the sixth embodiment of the present invention.
Figure 17A:
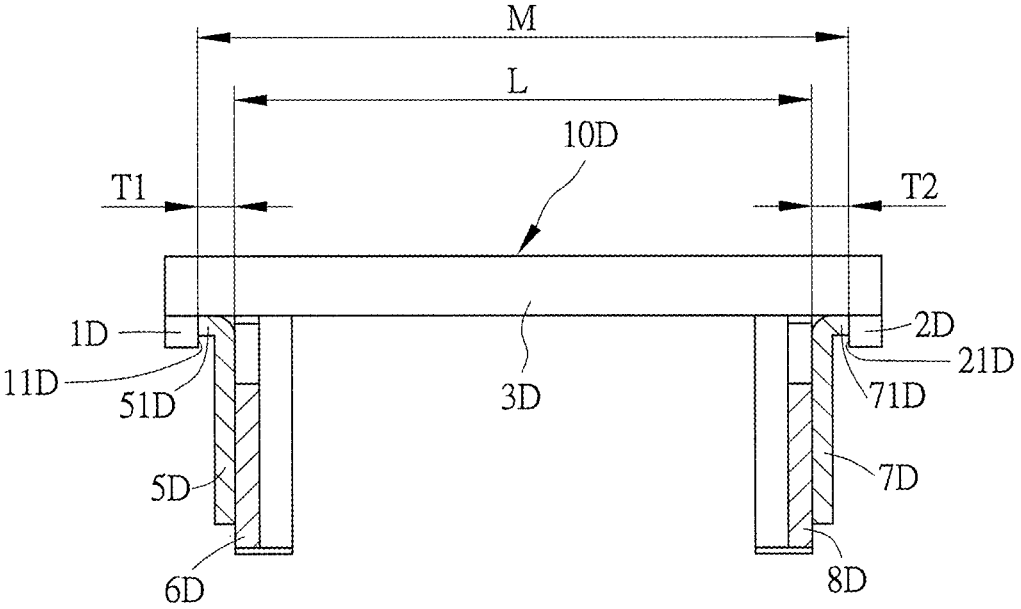
FIG. 17A is a cutaway view of FIG. 17.
Figure 18:
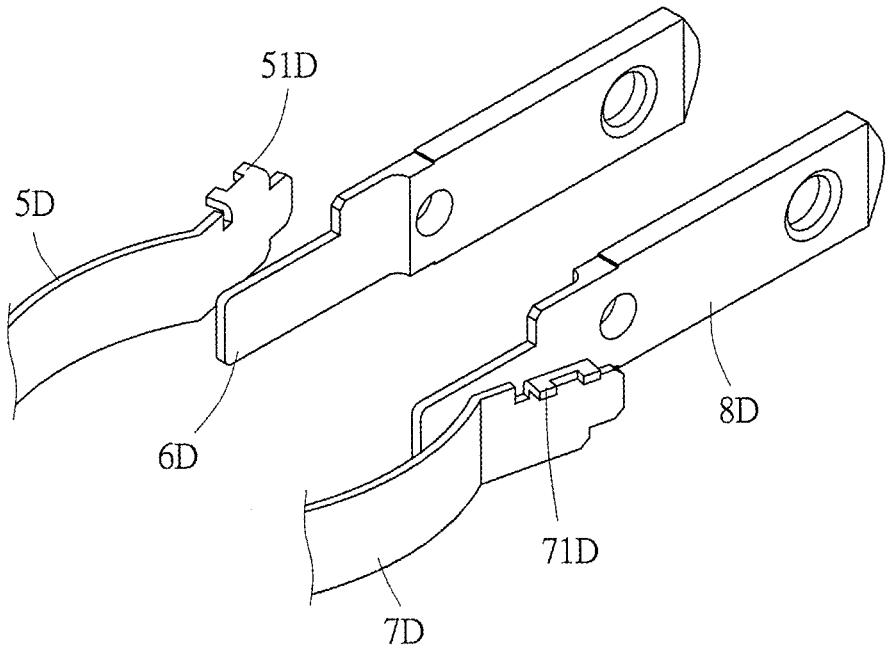
FIG. 18 shows a schematic view illustrating that when the conductive spring plate fixing element is destructed, an elastic force will enable the live wire spring plate and the neutral wire spring plate to displace outward relative to each other, according to the sixth embodiment of the present invention.

Referring to FIG. 17, FIG. 17A and FIG. 18, the present embodiment further discloses a live wire spring plate 5D, a live wire conductive plate 6D, a neutral wire spring plate 7D and a neutral wire conductive plate 8D. The live wire spring plate 5D is formed with a first abutting portion 51D and the neutral wire spring plate 7D is formed with a second abutting portion 71D. The first limiting element 1D and the second limiting element 2D abut respectively inward at the first abutting portion 51D and the second abutting portion 71D, allowing the live wire spring plate 5D and the live wire conductive plate 6D to contact with each other, as well as the neutral wire spring plate 7D and the neutral wire conductive plate 8D to contact with each other. The width of the limited part of the first abutting portion 51D is T1, and the width of the limited part of the second abutting portion 71D is T2. When the live wire spring plate 5D is abutted at the live wire conductive plate 6D, and the neutral wire spring plate 7D is abutted at the neutral wire conductive plate 8D, the live wire spring plate 5D is separated from the neutral wire spring plate 7D by an insulation distance L. The first limiting end 11D of the first limiting element 1D is abutted at the first abutting portion 51D, and second limiting end 21D of the second limiting element 2D isabutted at the second abutting portion 71D. The first limiting end 11D and the second limiting end 21D are disposed at the opposite internal surfaces of the first limiting element 1D and the second limiting element 2D. The distance between the first limiting end 11D and the second limiting end 21D, M, is equal to T1+T2+L. When any location in the first limiting element 1D, the second limiting element 2D or the connecting element 3D is destructed, an elastic force will enable the live wire spring plate 5D and the neutral wire spring plate 7D to displace outward relative to each other.

Figure 19:
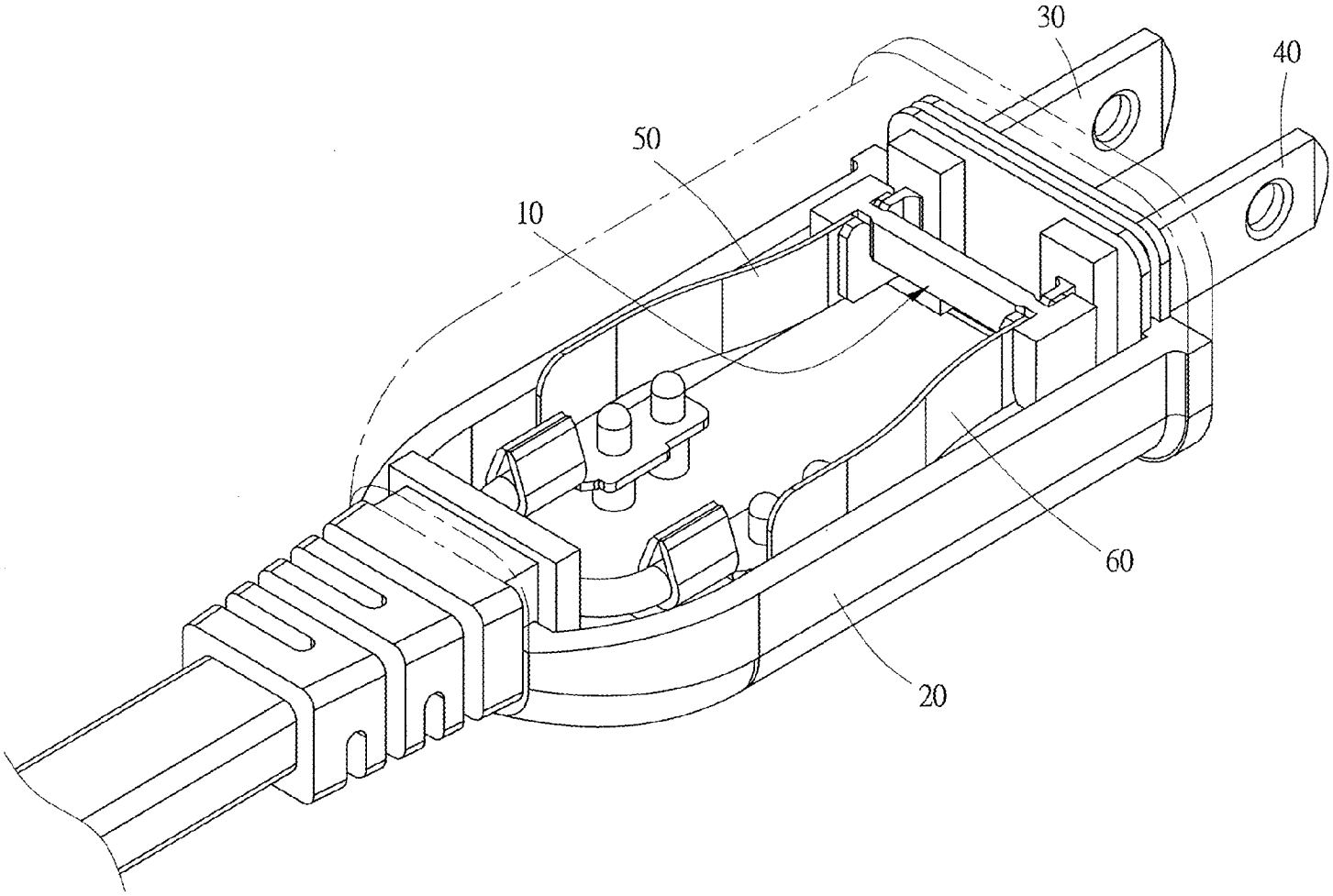
FIG. 19 shows a schematic view illustrating that the conductive spring plate fixing element is applied to a plug, according to the present invention.

Referring to FIG. 19, the conductive spring plate fixing element 10, according to the present invention, is used in overheat protection for a plug. The plug of the present embodiment comprises an insulative unit 20; a live wire conductive plate 30, which is provided in the insulative unit 20 and is extended out of the insulative unit 20; a neutral wire conductive plate 40, which is provided in the insulative unit 20 and is extended out of the insulative unit 20; a live wire spring plate 50, which is provided in the insulative unit 20 and corresponds to the live wire conductive plate 30; and a neutral wire spring plate 60, which is provided in the insulative unit 20 and corresponds to the neutral wire conductive plate 40. When the conductive spring plate fixing element 10 is used to limit and fix the live wire spring plate 50 and the neutral wire spring plate 60, if a location between the live wire spring plate 50 and the live wire conductive plate 30 is overheated or a location between the neutral wire spring plate 60 and the neutral wire conductive plate 40 is overheated, then the conductive spring plate fixing element 10 will lose the original limiting function thereof, allowing the live wire spring plate 50, the live wire conductive plate 30, the neutral wire spring plate 60 and the neutral wire conductive plate 40 to be separated apart at a same time.

Figure 20:
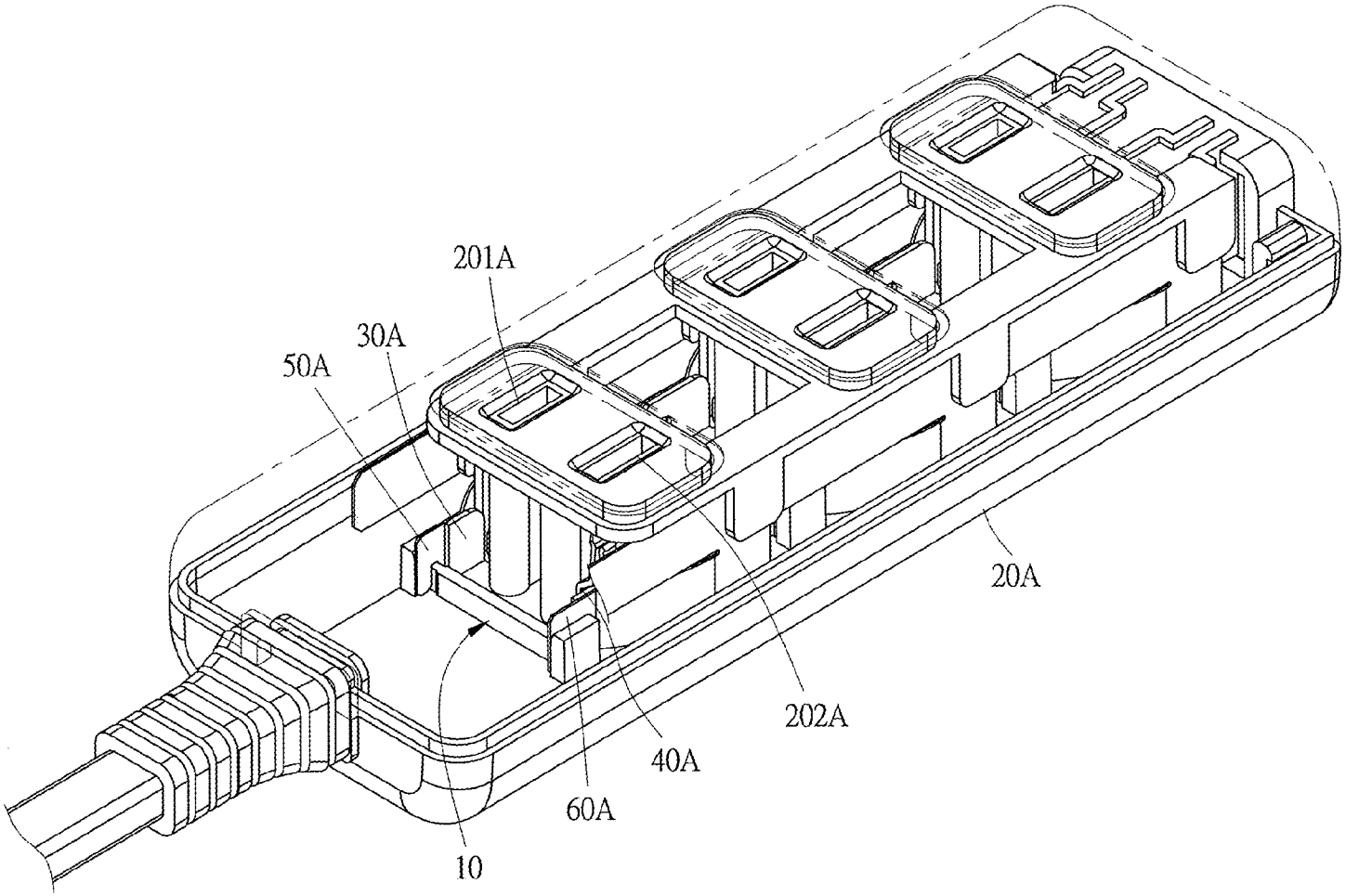
FIG. 20 shows a schematic view illustrating that the conductive spring plate fixing element is applied to a socket, according to the present invention.

Referring to FIG. 20, the conductive spring plate fixing element 10, according to the present invention, is used in overheat protection for a socket. The socket of the present embodiment comprises an insulative unit 20A, which is provided at least with a live wire receptacle 201A and an opposite neutral wire receptacle 202A; a live wire conductive plate 30A, which is installed in the insulative unit 20A and corresponds to the live wire receptacle 201A; a neutral wire conductive plate 40A, which is installed in the insulative unit 20A and corresponds to the neutral wire receptacle 202A; a live wire spring plate 50A, which is installed in the insulative unit 20A and corresponds to the live wire conductive plate 30A; and a neutral wire spring plate 60A, which is installed in the insulative unit 20A and corresponds to the neutral wire conductive plate 40A. When the conductive spring plate fixing element 10 is used to limit and fix the live wire spring plate 50A and the neutral wire spring plate 60A, if a location between the live wire spring plate 50A and the live wire conductive plate 30A is overheated or a location between the neutral wire spring plate 60A and the neutral wire conductive plate 40A is overheated, then the conductive spring plate fixing element 10 will lose the original limiting function thereof, allowing the live wire spring plate 50A, the live wire conductive plate 30A, the neutral wire spring plate 60A and the neutral wire conductive plate 40A to be separated apart at a same time.

Figure 21:
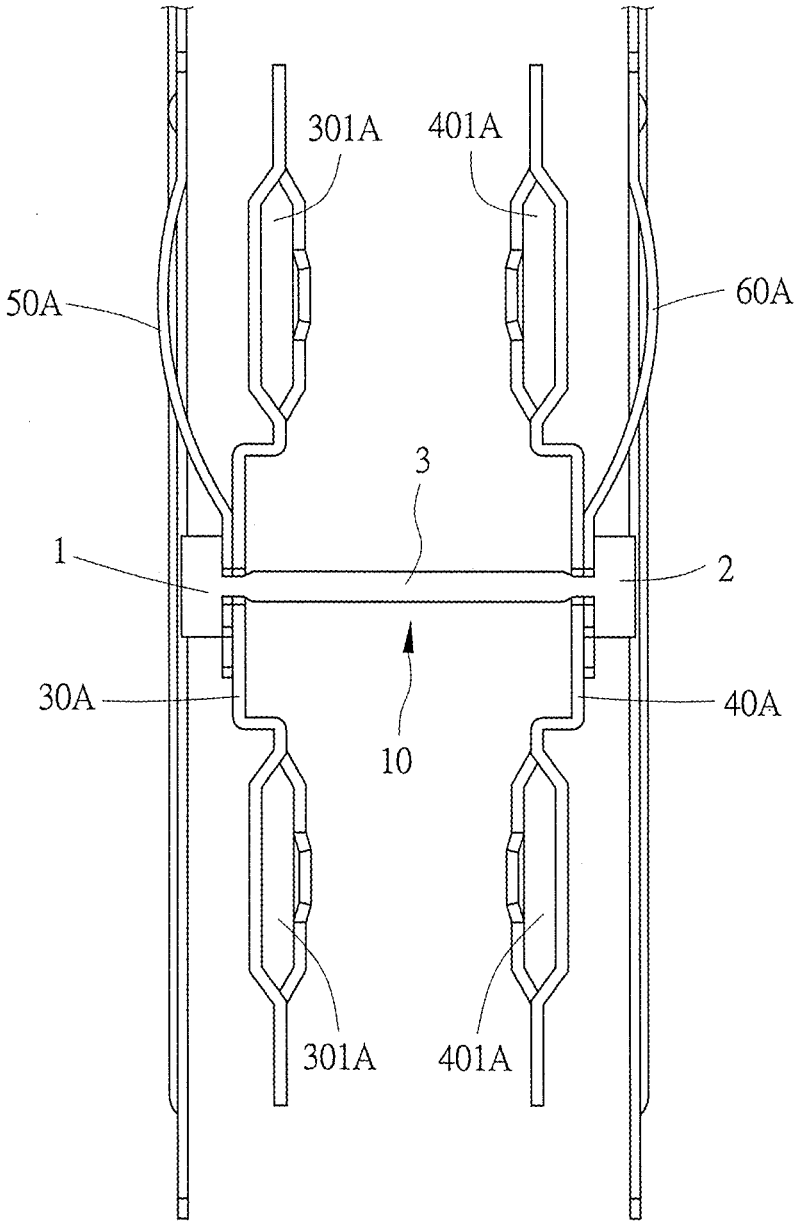
FIG. 21 shows a schematic view illustrating that the conductive spring plate fixing element is used to protect plural conductive slots at a same time, according to the present invention.

Referring to FIG. 21, it shows a variation in the abovementioned socket, wherein the live wire conductive plate 30A includes plural live wire slots 301A opposite to the abovementioned live wire receptacle 201A (as shown in FIG. 20), and the live wire conductive plate 30A contacts with one single live wire spring plate 50A; whereas, the neutral wire conductive plate 40A includes plural neutral wire slots 401A opposite to the abovementioned neutral wire receptacle 202A (as shown in FIG. 20), and the neutral wire conductive plate 40A contacts with one single neutral wire spring plate 60A. Under a normal condition, the live wire conductive plate 30A, the live wire spring plate 50A, the neutral wire conductive plate 40A and the neutral wire spring plate 60A are commonly limited by the first limiting element 1, the second limiting element 2 and the connecting element 3. Accordingly, by this configuration, a single conductive spring plate fixing plate 10 that assures the live wire and the neutral wire to be powered off simultaneously when overheating can be used to carry out overheat protection for plural live wire slots 301A and neutral wire slots 401A.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A conductive spring plate fixing element, being used to limit a live wire spring plate and a live wire conductive plate from contacting with each other, as well as a neutral wire spring plate and a neutral wire conductive plate from contacting with each other, wherein width of a limited part of the live wire spring plate is T1, width of a limited part of the neutral wire spring plate is T2, and the live wire spring plate is separated from the neutral wire spring plate by an insulation distance L; the conductive spring plate fixing element comprising a first limiting element, a second limiting element and a connecting element, with that the connecting element is connected with the first limiting element and the second limiting element, the first limiting element is provided with a first limiting end, the second limiting element is provided with a second limiting end, and the distance between the first limiting end and the second limiting end, M, is equal to T1+T2+L, allowing the first limiting end of the first limiting element and the second limiting end of the second limiting element to be abutted respectively at the live wire spring plate and the neutral wire spring plate; by using the connecting element to limit the live wire spring plate and the neutral wire spring plate, the live wire spring plate and the live wire conductive plate contact with each other, the neutral wire spring plate and the neutral wire conductive plate contact with each other, and the live wire spring plate and the neutral wire spring plate are provided at a same time with an elastic force allowing the live wire spring plate and the neutral wire spring plate to move away from each other; and when a location between the live wire spring plate and the live wire conductive plate is overheated or a location between the neutral wire spring plate and the neutral wire conductive plate is overheated, if any one location in the first limiting element, the second limiting element or the connecting element is destructed, then the first limiting element, the second limiting element and the connecting element all lose an original limiting function thereof, allowing the live wire spring plate, the live wire conductive plate, the neutral wire spring plate and the neutral wire conductive plate to be separated apart at a same time.

2. The conductive spring plate fixing element according to claim 1, wherein the live wire spring plate is formed with a first notch, the neutral wire spring plate is formed with a second notch, and the first notch and the second notch are used to accommodate the connecting element.

3. The conductive spring plate fixing element according to claim 2, wherein the live wire spring plate is formed with a first bending portion, the neutral wire spring plate is formed with a second bending portion, and the first limiting element and the second limiting element are abutted respectively at the first bending portion of the live wire spring plate and the second bending portion of the neutral wire spring plate.

4. The conductive spring plate fixing element according to claim 1, wherein the first limiting element is formed with a first collar to sheath the live wire spring plate, and the second limiting element is formed with a second collar to sheath the neutral wire spring plate.

5. The conductive spring plate fixing element according to claim 1, wherein the first limiting element, the second limiting element and the connecting element are all made of plastic, the first limiting element and the second limiting element are in a plate shape, a destructive portion is disposed between the connecting element and the first limiting element as well as between the connecting element and the second limiting element, and the thickness of the destructive portion is smaller than the thickness of the connecting element.

6. The conductive spring plate fixing element according to claim 1, wherein the first limiting element and the second limiting element are made of metal, the connecting element is made of plastic, and a destructive portion is disposed between the connecting element and the first limiting element as well as between the connecting element and the second limiting element.

7. The conductive spring plate fixing element according to claim 1, wherein the first limiting element and the second limiting element are all in a shape of bumps which are formed respectively at two opposite ends of the connecting element.

8. The conductive spring plate fixing element according to claim 1, wherein the live wire conductive plate includes plural live wire slots, the live wire conductive plate contacts with one single live wire spring plate, the neutral wire conductive plate includes plural neutral wire slots, the neutral wire conductive plate contacts with one single neutral wire spring plate, and the live wire conductive plate, the live wire spring plate, the neutral wire conductive plate and the neutral wire spring plate are commonly limited by the first limiting element, the second limiting element and the connecting element, under a normal condition.

9. A socket using the conductive spring plate fixing element, according to claim 1, comprising:

an insulative unit, which is provided with a live wire receptacle and an opposite neutral wire receptacle;

a live wire conductive plate, which is installed in the insulative unit and corresponds to the live wire receptacle;

a neutral wire conductive plate, which is installed in the insulation unit and corresponds to the neutral wire receptacle;

a live wire spring plate, which is installed in the insulative unit and corresponds to the live wire conductive plate; and a neutral wire spring plate, which is installed in the insulative unit and corresponds to the neutral wire conductive plate;

wherein by abutting the first limiting element and the second limiting element of the conductive spring plate fixing element at the live wire spring plate and the neutral wire spring plate respectively, and by using the connecting element to limit the live wire spring plate and the neutral wire spring plate, the live wire spring plate and the live wire conductive plate contact with each other, as well as the neutral wire spring plate and the neutral wire conductive plate contact with each other; and when a location between the live wire spring plate and the live wire conductive plate is overheated or a location between the neutral wire spring plate and the neutral wire conductive plate is overheated, if any one location in the first limiting element, the second limiting element or the connecting element is destructed, then the first limiting element, the second limiting element and the connecting element all lose an original limiting function thereof, allowing the live wire spring plate, the live wire conductive plate, the neutral wire spring plate and the neutral wire conductive plate to be separated apart at a same time.

10. A plug using the conductive spring plate fixing element, according to claim 1, comprising:

an insulative unit;

a live wire conductive plate, which is disposed in the insulative unit and is extended out of the insulative unit;

a neutral wire conductive plate, which is disposed in the insulative unit and is extended out of the insulative unit;

a live wire spring plate, which is disposed in the insulative unit and corresponds to the live wire conductive plate; and a neutral wire spring plate, which is disposed in the insulative unit and corresponds to the neutral wire conductive plate;

wherein by abutting the first limiting element and the second limiting element of the conductive spring plate fixing element at the live wire spring plate and the neutral wire spring plate respectively, and by using the connecting element to limit the live wire spring plate and the neutral wire spring plate, the live wire spring plate and the live wire conductive plate contact with each other, as well as the neutral wire spring plate and the neutral wire conductive plate contact with each other; and when a location between the live wire spring plate and the live wire conductive plate is overheated or a location between the neutral wire spring plate and the neutral wire conductive plate is overheated, if any one location in the first limiting element, the second limiting element or the connecting element is destructed, then the first limiting element, the second limiting element and the connecting element all lose an original limiting function thereof, allowing the live wire spring plate, the live wire conductive plate, the neutral wire spring plate and the neutral wire conductive plate to be separated apart at a same time.

* * * * *